US006283181B1

(12) United States Patent
Chiang

(10) Patent No.: US 6,283,181 B1
(45) Date of Patent: Sep. 4, 2001

(54) WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/732,433

(22) Filed: Dec. 7, 2000

(51) Int. Cl.[7] ..... B27C 1/00

(52) U.S. Cl. ..... 144/130; 33/642; 33/791; 83/522.19; 144/117.1; 409/210; 409/218; 451/9

(58) Field of Search ..... 33/626, 640, 642, 33/700, 710, 791, 792; 83/522.15, 522.19; 144/114.1, 117.1, 129, 130, 373; 409/210, 214, 218, 220; 451/9

(56) References Cited

U.S. PATENT DOCUMENTS 3,067,788 * 12/1962 Eschenburg ..... 144/117.1
5,795,113 * 8/1998 Wikey et al. ..... 409/210
5,927,357 * 7/1999 Welsh et al. ..... 83/522.19 X
6,131,628 * 10/2000 Chiang ..... 144/130

* cited by examiner

*Primary Examiner*—W. Donald Bray
(74) *Attorney, Agent, or Firm*—Christie, Parker & Hale, LLP

(57) ABSTRACT

A wood planing machine includes a base having posts, a pair of seats mounted on the posts, and a hollow supporting rod interconnecting the seats and formed with a slot. The wood planing machine further includes a cutter carriage mounted on the posts, a rotary cutter mounted on the cutter carriage, a height adjusting unit for adjusting the height of the cutter carriage, and a height indicator including a measuring scale, a slide member mounted in the supporting rod and slidable along the slot, a pointer connected to the slide member and extending to the measuring scale, a flexible string connected to the slide member and the cutter carriage, and an urging member for urging the string so as to permit the pointer to be movable along with the cutter carriage.

4 Claims, 7 Drawing Sheets

WOOD PLANING MACHINE

BACKGROUND OF THE INVENTION

1. Field of the Invention

This invention relates to a wood planing machine, more particularly to a wood planing machine having a cutter carriage with a height indicator above the cutter carriage for indicating working height of the cutter carriage.

2. Description of the Related Art

FIG. 1 illustrates a conventional wood planing machine 10. The wood planing machine 10 includes a base 11 with upstanding posts 12 disposed at the corners of the base 11 for supporting a cutter carriage 13 thereon. A motor 14 is mounted on the cutter carriage 13 for driving a rotary cutter (not shown). The wood planing machine 10 is provided with a height adjusting unit (not shown) for adjusting height of the cutter carriage 13 via a handle-wheel 15 which is mounted on a top end of one of the posts 12. A scale 16 is attached to the aforesaid one of the posts 12 below the handle-wheel 15 for measuring the height of the cutter carriage 13.

The wood planing machine 10 is disadvantageous in that it is relatively inconvenient for an operator to view the scale 16 while operating the handle-wheel 15 to adjust the height of the cutter carriage 13, and that there is an undesirable need for an operator to bend his or her body in order to view to the scale 16.

SUMMARY OF THE INVENTION

Therefore, it is an object of the present invention to provide a wood planing machine that is capable of overcoming the disadvantages described above.

Accordingly, a wood planing machine of this invention comprises: a base frame having a work table, a plurality of spaced apart posts that extend upright from the work table and that respectively have top end portions, a pair of opposite seats mounted securely on the top end portions of the posts, and a hollow supporting rod interconnecting the seats and formed with an elongated slot that extends in a transverse direction relative to the posts; a cutter carriage mounted on the posts above the work table and below the top ends of the posts, and movable along lengths of the posts; a rotary cutter mounted on the cutter carriage; a height adjusting unit for adjusting height of the cutter carriage relative to the work table; and a height indicator including a measuring scale provided on the supporting rod and aligned with the slot, a slide member mounted in the supporting rod and slidable along the slot, a pointer connected to the slide member and extending to the measuring scale, a roller guide pivoted on one end of the supporting rod, a flexible string passing through the roller guide and having one end secured to the slide member and the other end extending downwardly from the roller guide to be secured to the cutter carriage, and an urging member mounted in the supporting rod and having one end secured to the supporting rod and the other end secured to the slide member for urging the string so as to permit the pointer to be movable along with the cutter carriage.

BRIEF DESCRIPTION OF THE DRAWINGS

In drawings which illustrate an embodiment of the invention.

DETAILED DESCRIPTION OF THE PREFERRED EMBODIMENT

Figure 1:
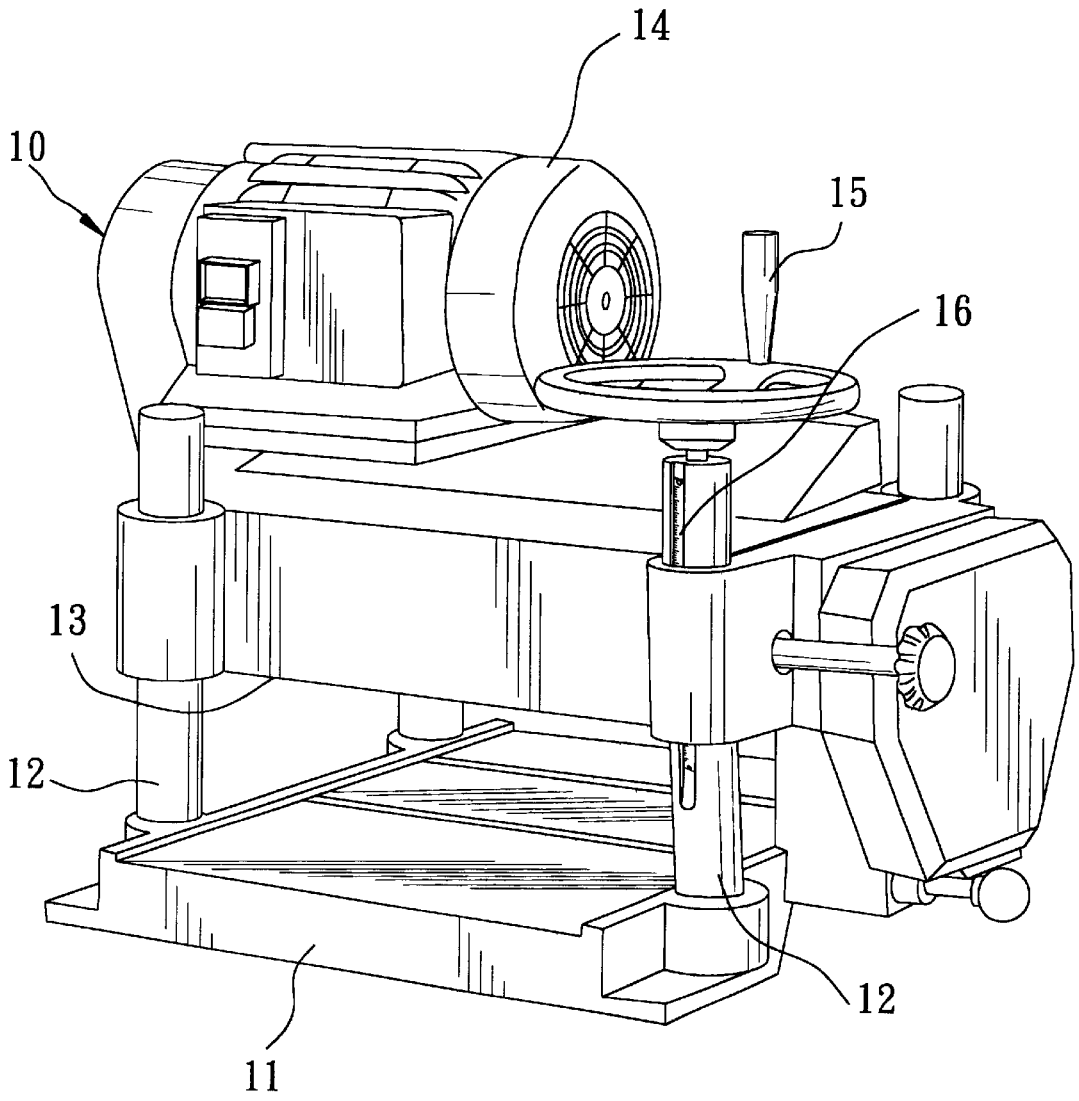
FIG. 1 PRIOR ART
FIG. 1 is a perspective view of a conventional wood planing machine.

FIGS. 2 to 5 illustrate a wood planing machine embodying this invention. The wood planing machine includes a base frame 20 having a work table 21 and four posts 22 raising uprightly from four corners of the work table 21, a pair of opposite seats 25 disposed at two opposite sides of the work table 21 and mounted on top end portions of the posts 22, and a pair of parallel hollow front and rear supporting rods 26, 27 interconnecting the seats 25. The front supporting rod 26 has two opposite ends 261, 262 extending into the seats 25, and is formed with an elongated slot 260 that extends in a transverse direction relative to the posts 22 at a bottom side thereof between the opposite ends 261, 262. The wood planing machine further includes a cutter carriage 23 mounted movably on the posts 22, a motor-driven rotary cutter 24 mounted on the cutter carriage 23, a height adjusting unit (not shown) provided with a handle-wheel 31 for adjusting height of the cutter carriage 23, and a height indicator for indicating working height of the cutter carriage. A positioning seat 84 is secured to the cutter carriage 23 via screw means.

The height indicator includes a measuring scale 28 provided on an upper surface of the front supporting rod 26 and aligned with the slot 260, a slide member 70 mounted in the front supporting rod 26 and slidable along the slot 260, a pointer 92 connected to the slide member 70 and extending to the measuring scale 28, a roller guide 50 pivoted on the end 262 of the front supporting rod 26 via a pivot pin 52, a flexible string 80 passing through the roller guide 50 and having one end 81 secured to the slide member 70 via screw means 83 and the other end 82 extending downwardly from the roller guide 50 to be secured to the cutter carriage 23 via the positioning seat 84 and screw means 85, and an urging member 60 mounted in the front supporting rod 26 and having one end 61 secured to the end 261 of the front supporting rod 26 of the base frame 20 via a positioner 40 and the other end 62 secured to the slide member 70 for urging the string 80 so as to permit the pointer 92 to be movable along with the cutter carriage 23. Preferably, the urging member 60 is a coil spring.

The slide member 70 includes a block piece 72 mounted in the front supporting rod 26, slidable along the slot 260, and interconnecting the urging member 60 and the string 80, a protrusion 71 projecting from the block piece 72 to be secured to the other end 62 of the urging member 60, and a sector-shaped linkage piece 91 spanning the slot 260 at the bottom side of the front supporting rod 26 and interconnecting the block piece 72 via screw means 93 and the pointer 92 via screw means 94.

The positioner 40 has an anchored portion 41 engaging the end 261 of the front supporting rod 26, a block portion 42 extending from the anchored portion 41 into the front supporting rod 26, and a protrusion 43 extending from the block portion 42 to connect with the end 61 of the urging member 60.

Figure 2:
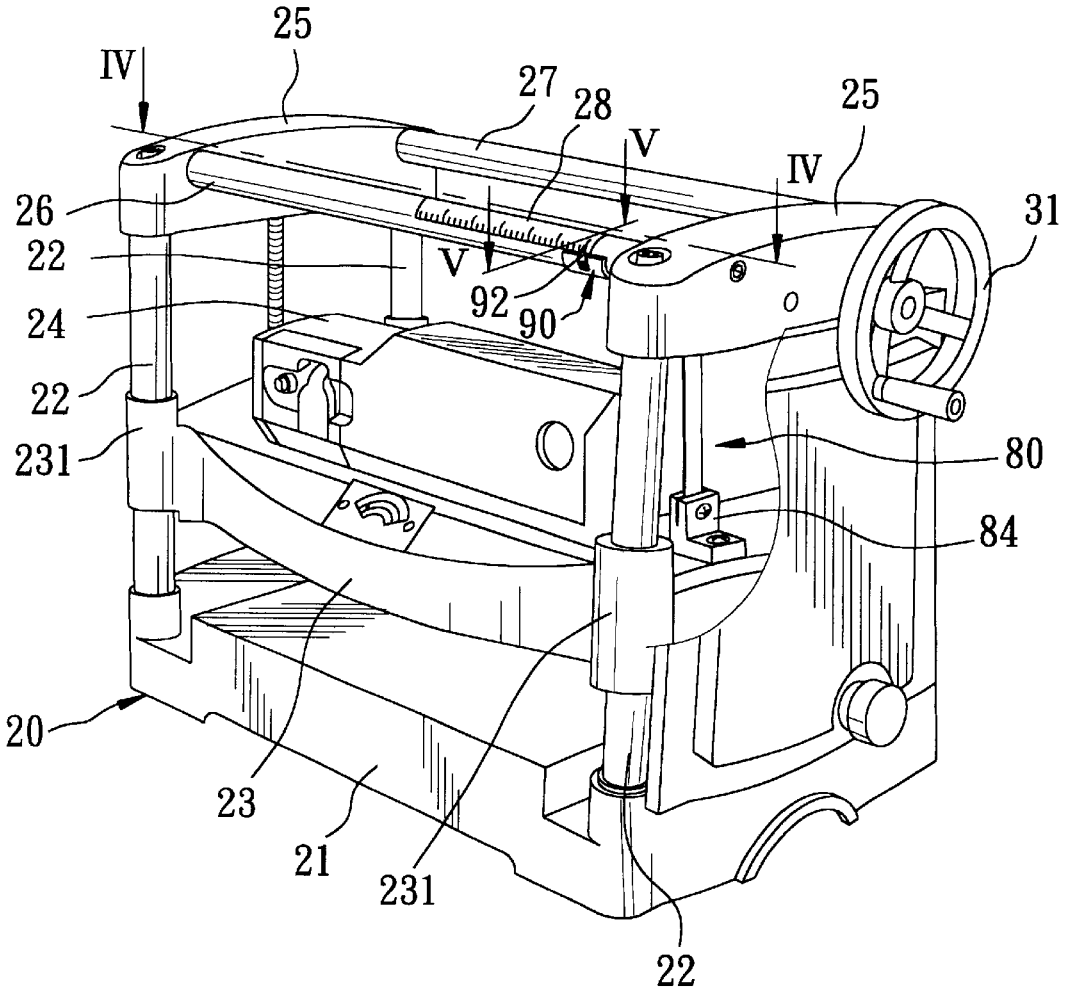
FIG. 2 is a perspective view of a wood planing machine embodying this invention, with a cutter carriage illustrated at a lower position.
Figure 3:
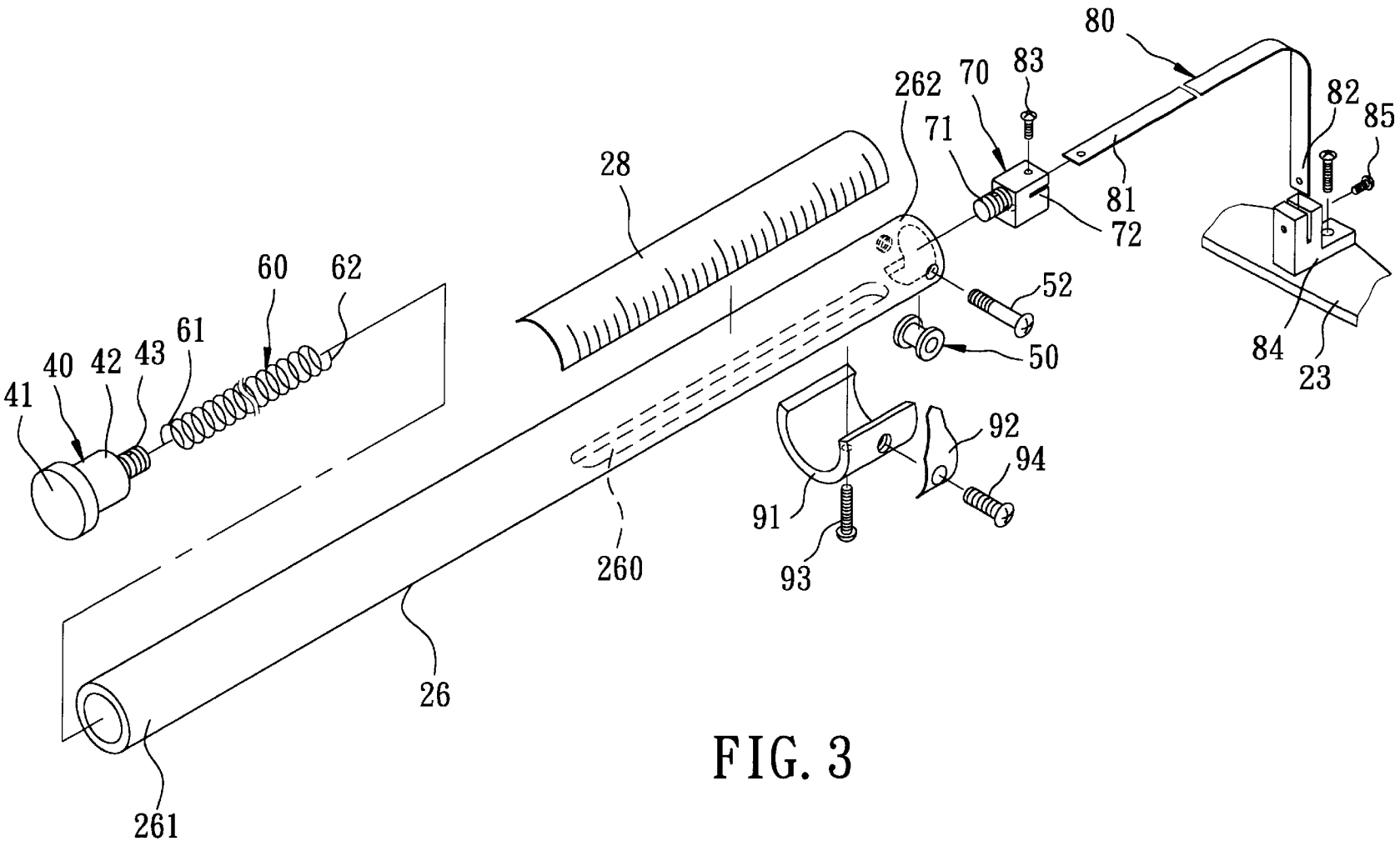
FIG. 3 is an exploded perspective view of a height indicator of the wood planing machine of FIG. 2.
Figure 4:
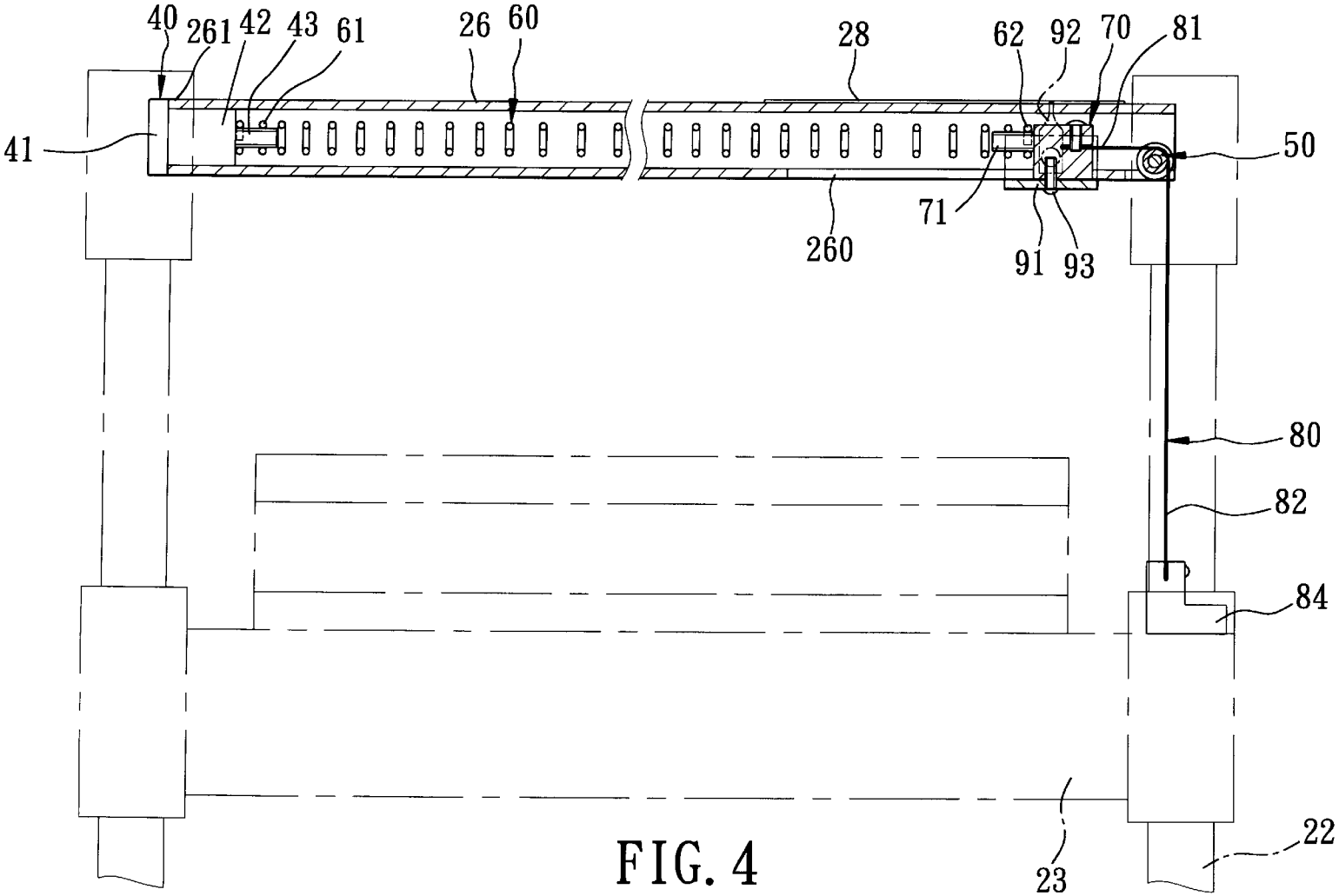
FIG. 4 is a cross-sectional side view of the height indicator taken along line IV—IV in FIG. 2.
Figure 5:
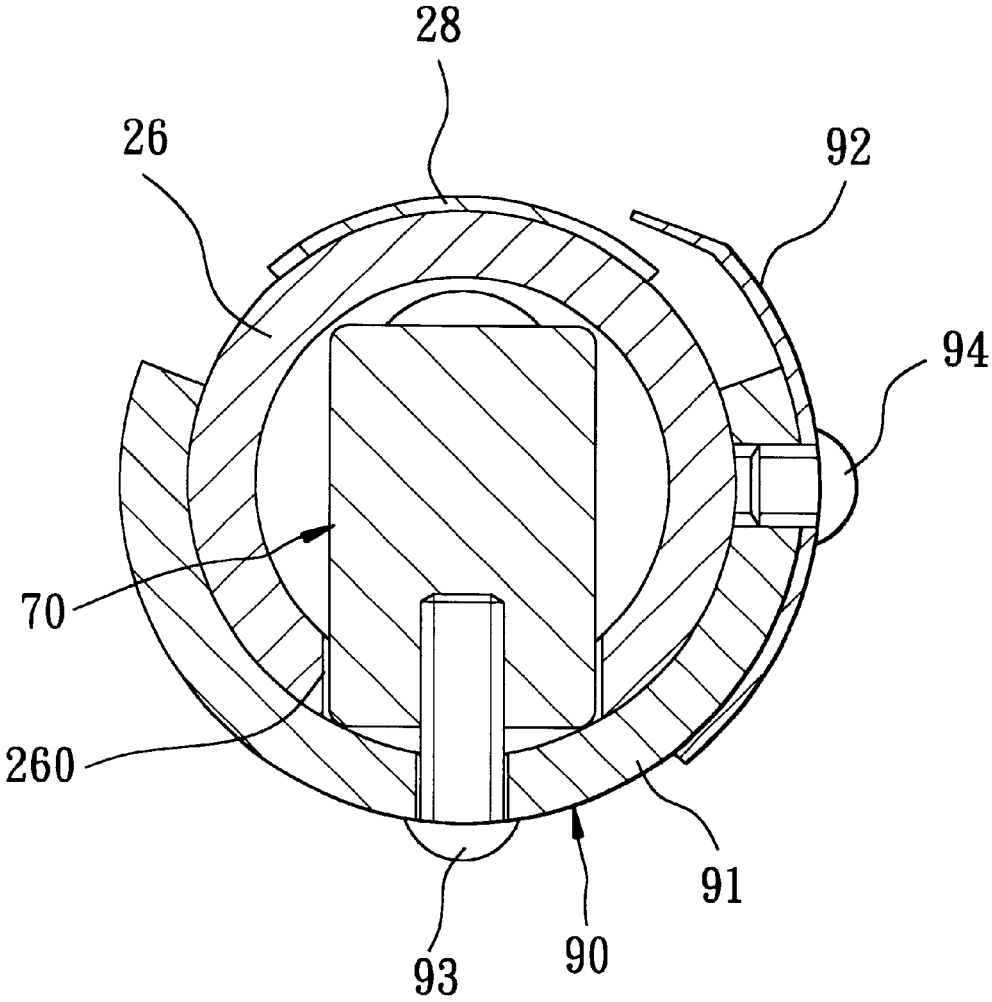
FIG. 5 is a cross-sectional side view of the height indicator taken along line V—V in FIG. 2.
Figure 6:
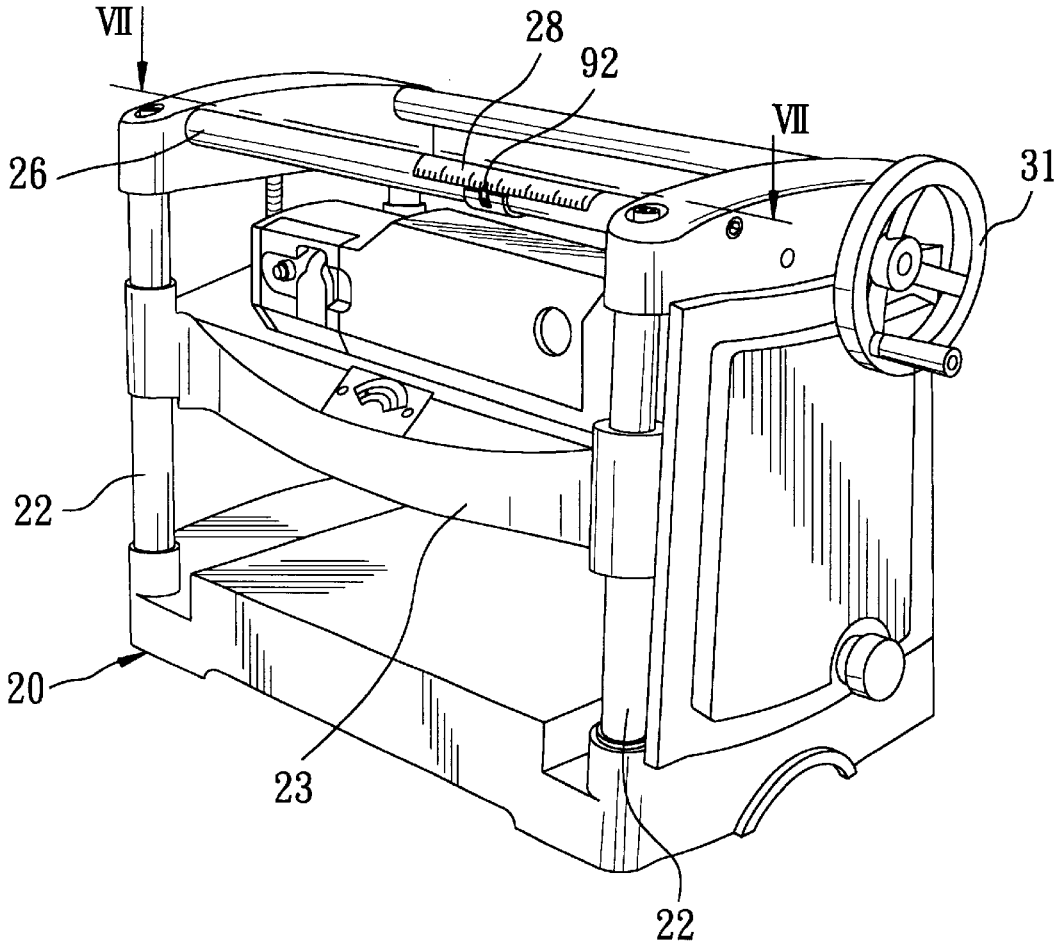
FIG. 6 is a perspective view of the wood planing machine of FIG. 2, with the cutter carriage illustrated at an upper position.
Figure 7:
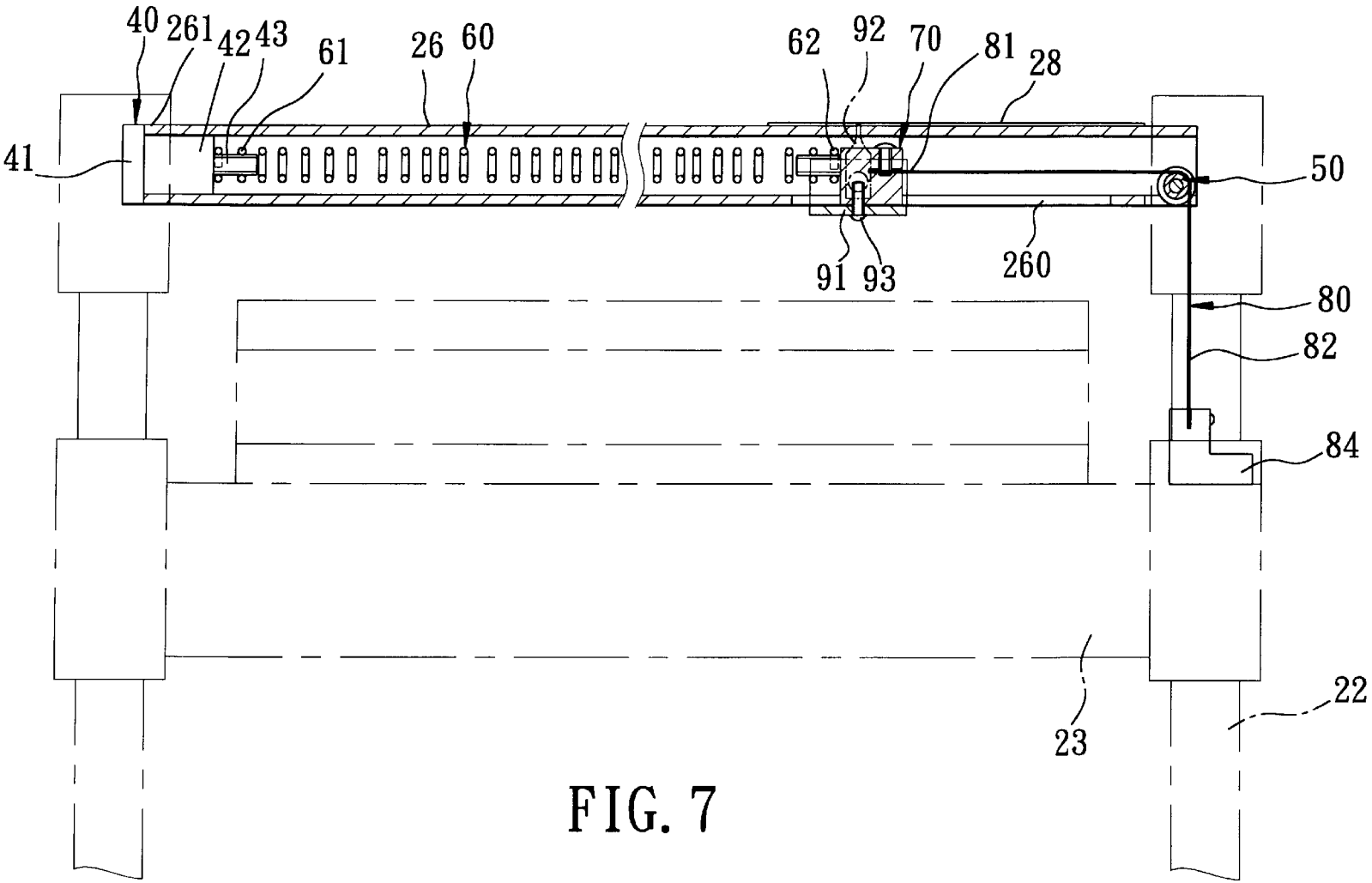
FIG. 7 is a cross-sectional side view of the height indicator taken along line VII—VII in FIG. 6.

FIGS. 6 and 7 illustrate a new position of the pointer 92 with reference to the scale 28 when the cutter carriage 23 is moved upwardly to an upper position from a lower position shown in FIGS. 2 and 4. As such, the height of the cutter carriage 23 relative to the work table 21 can be viewed simutaneously with the adjustment of the height adjusting unit by operating the handle-wheel 31, thereby eliminating the inconvenience encountered in the prior art.

With the invention thus explained, it is apparent that various modifications and variations can be made without departing from the spirit of the present invention. It is therefore intended that the invention be limited only as recited in the appended claims.

I claim:

1. A wood planing machine comprising:

a base frame having a work table, a plurality of spaced apart posts that extend upright from said work table and that respectively have top end portions, a pair of opposite seats mounted securely on said top end portions of said posts, and a hollow supporting rod interconnecting said seats and formed with an elongated slot that extends in a transverse direction relative to said posts;

a cutter carriage mounted on said posts above said work table and below said top ends of said posts, and movable along lengths of said posts;

a rotary cutter mounted on said cutter carriage;

a height adjusting unit for adjusting height of said cutter carriage relative to said work table; and a height indicator including a measuring scale provided on said supporting rod and aligned with said slot, a slide member mounted in said supporting rod and slidable along said slot, a pointer connected to said slide member and extending to said measuring scale, a roller guide pivoted on one end of said supporting rod, a flexible string passing through said roller guide and having one end secured to said slide member and the other end extending downwardly from said roller guide to be secured to said cutter carriage, and an urging member mounted in said supporting rod and having one end secured to said supporting rod and the other end secured to said slide member for urging said string so as to permit said pointer to be movable along with said cutter carriage.

2. The wood planing machine of claim 1, wherein said urging member is a coil spring.

3. The wood planing machine of claim 2, wherein said slide member includes a block piece mounted in said supporting rod, slidable along said slot, and interconnecting said coil spring and said string, and a sector-shaped linkage piece spanning said slot at a bottom side of said supporting rod and interconnecting said block piece and said pointer.

4. The wood planing machine of claim 1, wherein said supporting rod has two opposite ends respectively extending into said seats, said height indicator further including a positioner having an anchored portion engaging one of said ends of said supporting rod, and a block portion extending from said anchored portion into said supporting rod to connect with said urging member.

* * * * *